US006006508A

United States Patent [19]

Shigekawa

[11] Patent Number: 6,006,508

[45] Date of Patent: Dec. 28, 1999

[54] MOTOR DRIVE TYPE FALSE TWISTING DEVICE WITH THREE SPINDLES AND A PLURALITY OF FRICTION DISCS

[75] Inventor: Yasushi Shigekawa, Matsuyama, Japan

[73] Assignee: Teijin Seiki Co., Ltd., Japan

[21] Appl. No.: 09/114,096

[22] Filed: Jul. 13, 1998

[51] Int. Cl.[6] ..... D01H 1/24

[52] U.S. Cl. ..... 57/338; 57/339; 57/348

[58] Field of Search ..... 57/337, 338, 339, 57/340, 348

[56] References Cited

U.S. PATENT DOCUMENTS

| | | | |
|---|---|---|---|
| 4,047,374 | 9/1977 | Venot | 57/77.45 |
| 5,414,989 | 5/1995 | Radar et al. | 57/339 |
| 5,794,429 | 8/1998 | Overstrass et al. | 57/339 |

FOREIGN PATENT DOCUMENTS

| | | | |
|---|---|---|---|
| 4001957 | 7/1991 | Germany . | |
| 4110464 | 10/1992 | Germany . | |
| 63-282328 | 11/1988 | Japan | 57/348 |

*Primary Examiner*—William Stryjewski

*Attorney, Agent, or Firm*—Rothwell, Figg, Ernst & Kurz, P.C.

[57] ABSTRACT

A false twisting device with three spindles and a plurality of friction discs wherein it is driven by means of individual motor so as to decrease generation of noise, adjustment of false twisting condition can be done for individual work stations, and maintenance service or replacement of spindles of the friction false twisting device can be done easily. A motor mounted on a motor mounting has an output pulley attached to an output shaft thereof, the motor mounting has a winding pulley rotatably mounted thereon, the output pulley and the winding pulley have a drive belt wound therearound, a spindle mounting has a belt engaging pulley rotatably mounted thereon, and the belt engaging pulley and three spindles are operatively connected to each other so that the rotation of the belt engaging pulley is transmitted to the spindles, and a lock member for maintaining the belt engaging pulley to engage with the drive belt at a surface opposite to that engaging with the winding pulley when the spindle mounting is attached to the motor mounting.

21 Claims, 5 Drawing Sheets

MOTOR DRIVE TYPE FALSE TWISTING DEVICE WITH THREE SPINDLES AND A PLURALITY OF FRICTION DISCS

BACKGROUND OF THE INVENTION

1. Field of the Invention

The present invention relates to a motor drive type false twisting device with three spindles and a plurality of friction discs. Especially, the present invention relates to a false twisting device with three spindles and a plurality of friction discs which is used in a high speed draw and texturing machine, a high speed false twist texturing machine and so on, and which is provided with a motor for driving the false twisting device with three spindles and a plurality of friction discs.

2. Description of Related Art

False twisting devices with three spindles, wherein each spindle is provided with a plurality of friction discs and the spindles of which are located at apexes of an imaginary triangle, are widely used as twisting devices in false twist texturing machines or draw and yarn texturing machines.

A so-called tangential belt system has been known as a driving mechanism of such false twisting devices with three spindles and a plurality of friction discs. More specifically, a tangential belt is run along the machine frame of a yarn texturing machine, such as a draw and false twist texturing machine or a false twist texturing machine, wherein a plurality of friction false twisting devices are disposed. Each false twisting device is provided with three spindles and a plurality of friction discs secured to the spindles, respectively. Driving wheels of the false twisting devices are pressed against the running belt. Thus, the driving force is transmitted from the driving wheels to the spindles so that the three spindles are rotated in the same direction at the same rotational speed.

In the above-described friction false twisting device with three spindles and a plurality of friction discs, the spindles are fixed to a unit base. In the tangential belt system wherein a plurality of friction false twisting devices are driven by a single belt, noise is generated because the driving wheels of the false twisting devices are pressed against the belt and because the driving belt is run for a long distance. In addition, in this system, since the friction false twisting devices are driven by means of frictional engagement between the belt and the driving wheels, it is very difficult to individually control the false twisting devices so as to avoid unevenness of twists between a plurality of work stations.

In order to solve such problems, recently a so-called individual motor driving system has been proposed. More specifically, a driving motor is disposed for each false twisting device, and the driving motor and the spindles are operatively connected to each other. The applied connecting methods are: a method wherein the driving motor and the spindle are connected to each other by means of a coupling; and a method wherein timing pulleys are secured to an output shaft of the driving motor and one of the three spindles of the false twisting device, respectively, and they are connected to each other by means of a toothed belt. (For example, D1-A1-P4001957.8.)

In such an individual motor driving system, it is necessary to maintain the distance between both the pulleys at a predetermined amount and select the tension in the belt at a predetermined value so that transmittal operation can be ensured without need of maintenance service between the drive timing pulley disposed at the motor side and the driven timing pulley disposed at the spindle side.

In order to satisfy such requirements, it is necessary for a friction false twisting device of an individual driving type that the false twisting device and the motor can be removed together with the unit base from the spindle mounting or frame of the yarn texturing machine during maintenance service or replacement of friction discs. However, in conventionally proposed devices, such removal operation is not easy.

Contrary to this, DE-A1-4110464.1 discloses a device wherein a base plate of the false twisting device is detachably disposed on a movable support or a turnable support plate. The support or the support plate is movable towards a driving motor fixedly mounted on a spindle mounting of the textile machine. When the spindles are to be removed, they are moved toward the driving motor together with the base plate of the false twisting device so that a toothed belt which has been engaged between the driving motor and the spindles is loosened. Under this condition, the false twisting device is upwardly removed together with the base plate.

Problems to be Solved by the Invention

However, in such a device, it is necessary that the false twisting device to be lifted upwardly together with the base plate when the false twisting device is removed. In order to allow upward removal, it is necessary to spare a wide space above the false twisting device so that upward removal is permitted.

However, in an actual draw and false twist texturing machine or an actual false twist texturing machine, a cooling device for cooling a yarn running from a heat setting heater or the like is disposed above the false twisting device. Accordingly, there is not such a enough space. Further, if the cooling device or the like is removed in order to remove the false twisting device with three spindles and a plurality of friction discs, complicated operations such as adjustment of yarn passage are necessary upon re-construction. In addition, if it is tried to remove the false twisting device with three spindles and a plurality of friction discs without removing the cooling device or the like, there may be a problem that the false twisting device or the cooling device is damaged due to collision between the cooling device and the false twisting device.

BRIEF SUMMARY OF THE INVENTION

Objects of the Invention

It is an object of the present invention to obviate the above-described problems inherent to the conventional devices.

It is another object of the present invention to provide a false twisting device with three spindles and a plurality of friction discs wherein it is driven by means of individual motor so as to decrease generation of noise, adjustment of false twisting condition can be done for individual work stations, and maintenance service or replacement of spindles of the friction false twisting device can be done easily.

Means to Solve the Problems

According to the present invention, the above-described, objects are achieved by a motor drive type false twisting device with three spindles and a plurality of friction discs comprises:

- a motor mounting which is fixedly secured to a yarn texturing machine and which has a motor mounted thereon for driving at least one of the spindles;
- a spindle mounting which has the three spindles provided with a plurality of the friction discs rotatably mounted thereon at apexes of an imaginary triangle and which can be attached to and detached from the motor mounting;

the motor mounted on the motor mounting having an output pulley attached to an output shaft thereof, the motor mounting having a winding pulley rotatably mounted thereon, the output pulley and the winding pulley having a drive belt wound therearound, the spindle mounting having a belt engaging pulley rotatably mounted thereon, and the belt engaging pulley and the three spindles being operatively connected to each other so that the rotation of the belt engaging pulley is transmitted to the spindles; and a lock member for maintaining the belt engaging pulley to engage with the drive belt at a surface opposite to that engaging with the winding pulley when the spindle mounting is attached to the motor mounting.

The three spindles may have spindle pulleys secured thereto, respectively, and a spindle drive belt is wound around the spindle pulleys of the three spindles. Alternatively, one of the three spindles may have vertically overlapped first and second pulleys secured thereto, one of the remaining spindles may have a first pulley secured thereto and the other remaining spindle may have a second pulley, a first spindle drive belt may be wound between the first pulleys, and a second spindle drive belt may be wound between the second pulleys.

In this occasion, one of the three spindles may have the belt engaging pulley secured thereto, or the belt engaging pulley may be mounted spaced from the three spindles, and the belt engaging pulley and one of the three spindles may be connected to each other by means of a belt.

The drive belt used in the present invention may be a flat belt. When the output pulley and the winding pulley are toothed pulleys, the drive belt may be a toothed belt. When the toothed belt is used, it may have teeth on one side or on both sides.

It is preferable for the present invention that a sensor for detecting rotational speed of the belt engaging pulley, the spindle drive belt or the spindles is disposed and that the rotation of the motor is controlled based on the rotational speed detected by the sensor.

Further, the present invention also achieves the above-described objects by a motor drive type false twisting device with three spindles and a plurality of friction discs comprises:

a motor mounting which is fixedly secured to a yarn texturing machine and which has a motor mounted thereon for driving at least one of the spindles;

a spindle mounting which has the three spindles provided with a plurality of the friction discs rotatably mounted thereon at apexes of an imaginary triangle and which can be attached to and detached from the motor mounting;

an output shaft of the motor mounted on the motor mounting being operatively connected to a belt engaging pulley, the three spindles on the spindle mounting having pulleys secured thereto, the pulleys being operatively connected to each other by means of a drive belt; and a lock member for maintaining the belt engaging pulley to engage with the drive belt at a surface opposite to that engaging with the pulleys secured to the spindles when the spindle mounting is attached to the motor mounting.

In this occasion, the three spindles may have spindle pulleys secured thereto, respectively, and a spindle drive belt may be wound around the spindle pulleys of the three spindles. Alternatively, one of the three spindles may have vertically overlapped first and second pulleys secured thereto, one of the remaining spindles has a first spindle pulley secured thereto and the other remaining spindle may have a second spindle pulley, a first spindle drive belt may be wound between the first spindle pulleys, a second spindle drive belt may be wound between the second spindle pulleys, and the belt engaging pulley may engage with the first or second drive belt.

The output shaft of the motor may have the belt engaging pulley secured thereto. Alternatively, the belt engaging pulley may be mounted spaced from the output shaft of the motor, and the output shaft and one of the three spindles may be connected to each other by means of a belt. In the latter case, the belt engaging pulley may be rotatably supported at a fixed position or may be rotatably supported on a swingable lever which is swingable around a output shaft of the motor or a winding pulley spaced from the output shaft.

The drive belt may be a toothed belt having teeth on one side or on both the sides. In the latter case, it is preferable that the belt engaging pulley is a toothed pulley.

It is preferable that a sensor for detecting rotational speed of the belt engaging pulley, the spindle drive belt or the spindles is disposed, and that the rotation of the motor is controlled based on the rotational speed detected by the sensor.

BRIEF DESCRIPTION OF THE SEVERAL VIEWS OF THE DRAWINGS

Some embodiments of the present invention will now be explained with reference to the accompanying drawings, wherein.

DETAILED DESCRIPTION OF THE INVENTION

Preferred Embodiments

Figure 1:
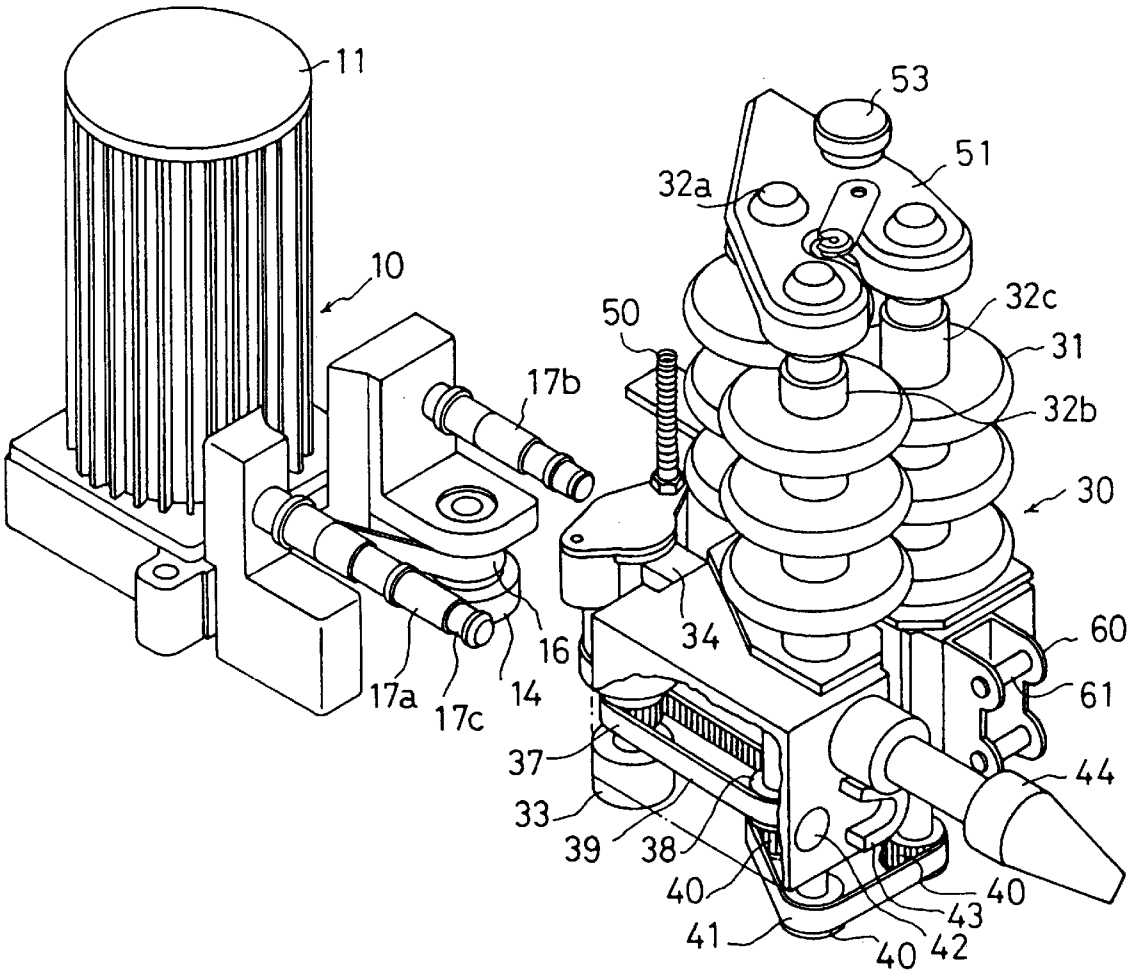
FIG. 1 is a perspective view of the first embodiment of the present invention.
Figure 2:
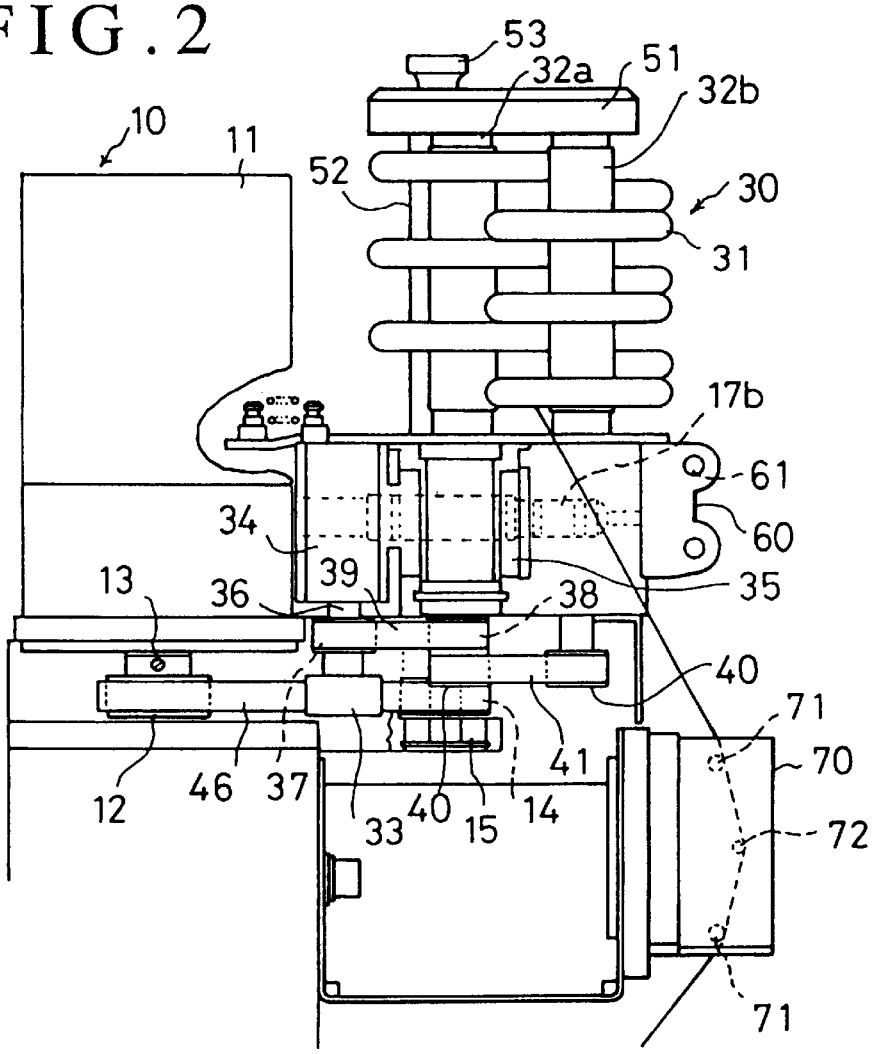
FIG. 2 is a front view of FIG. 1.
Figure 3:
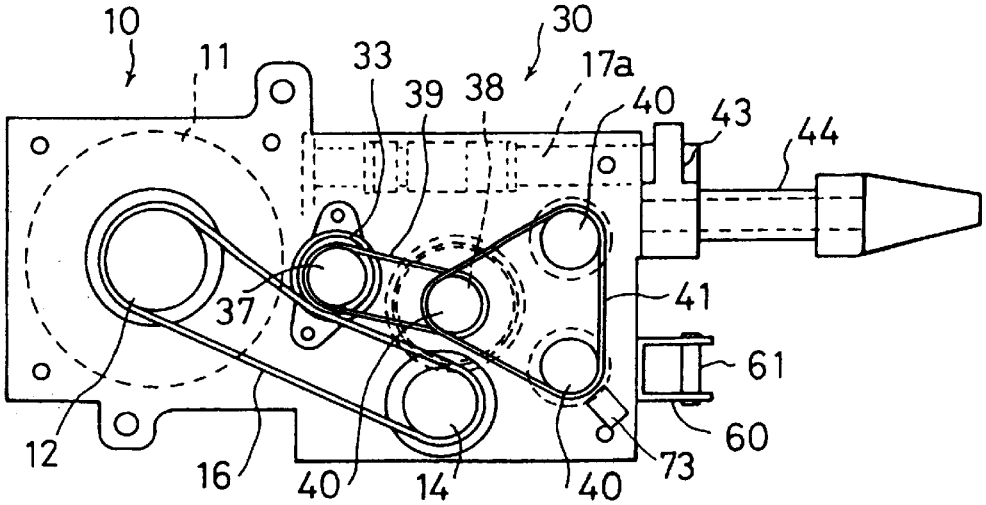
FIG. 3 is a bottom view of FIG. 2.

Referring to FIGS. 1 to 3, a motor mounting 10 has a motor 11 secured thereto. An output shaft of the motor 11 has an output pulley secured thereto by means of a set screw 13 (FIG. 2). Further, the motor mounting 10 has a winding pulley 14 rotatably mounted thereon by means of a vertically spaced pair of bearings 15 (FIG. 2).

The outer surfaces of the output pulley 12 and the winding pulley 14 are flat in this embodiment, and a drive belt 16 which is made of a flat belt is wound around both the pulleys 12 and 14.

As illustrated in FIG. 1, a pair of rods 17*a* and 17*b* extend horizontally from the side of the motor mounting 10. Among the rods 17*a* and 17*b*, the rod 17*a* has a circumferential groove at the front end thereof, which serves as an engaging portion 17*c*.

A spindle mounting 30 has spindles 32*a*, 32*b* and 32*c*, rotatably mounted at apexes of an imaginary equilateral triangle as shown in FIG. 3. Each of the spindles 32*a*, 32*b* and 32*c*, has a plurality of (3 in the illustrated embodiment) friction discs 31 mounted thereon, In this embodiment, a column 52 (FIG. 2) extends vertically from the spindle mounting 30 and has a top plate 51 secured at the upper end thereof by means of a set screw 53 so that the spindles 32*a*, 32*b* and 32*c* are supported at both ends thereof.

The lower end of each of the spindles 32*a*, 32*b* and 32*c* has a pulley 40 secured thereto, and a spindle drive belt 41 is wound around the pulleys 40. In this embodiment, the pulleys 40 are toothed pulley, and the spindle drive belt 41 is a toothed belt.

As illustrated in FIG. 2, a swing lever 34 (see FIG. 1) is turnably supported coaxial with one spindle 32*a* of the three spindles 32*a*, 32*b* and 32*c* by means of a bearing bush 35, and the swing lever 34 has a shaft 36 rotatably and downwardly supported from the end thereof.

The shaft 36 has a belt engaging pulley 33 secured at the lower end thereof, and it also has a pulley 37 secured thereto at a position above the belt engaging pulley 33.

Further, the above-described spindle 32*a* has a pulley 38 secured at a position above the pulley 40, and a belt 39 is wound around the pulley 37 and the pulley 38. Because of the above-described construction, when the belt engaging pulley 33 is rotated, the rotation of the belt engaging pulley 33 is transmitted to the pulley 37 via the shaft 36, and then it is transmitted from the pulley 37 to the spindle 32*a* via the belt 39 and the pulley 38, and thus, the spindle 32*a* is driven. Since the spindles 32*a*, 32*b* and 32*c* are operatively connected to each other by means of the pulleys 40 and the spindle drive belt 41, the rotation of the belt engaging pulley 33 is transmitted to the spindles 32*a*, 32*b* and 32*c*. Thus, all the friction discs 31 which are secured to the spindles 32*a*, 32*b* and 32*c*, rotate in the same direction.

As illustrated in FIG. 1, the spindle mounting 30 has a pair of through holes 42 (only one of which is illustrated in FIG. 1) formed horizontally at the side thereof. The above-described rods 17*a* and 17*b* projecting from the motor mounting 10 can be inserted into the through holes 42*a*. When the rods 17*a* and 17*b* are inserted into the through holes 42*a*, the engaging portion 17*c* formed at the end of the rod 17*a* projects from the through hole 42*a* to the outside of the spindle mounting 30.

A lock member 43 which can engage with the engaging portion 17*c* of the outwardly extending rod 17*a* is disposed on the spindle mounting 30. More specifically, especially as illustrated in FIG. 1, a lock lever 44 extends from the spindle mounting 30. The lock lever 44 is turnable around a longitudinal axis thereof, and it has a U-shaped lock member 43 at the bottom portion thereof. Thus, when the lock lever 44 is turned by hand around the longitudinal axis thereof, the lock member 43 engages with the engaging portion 17*c* of the rod 17*a*. As a result, the spindle mounting 30 is secured integrally to the motor mounting 10. In this occasion, the belt engaging pulley 33 secured at the end of the swing lever 34 becomes in contact with the outer surface of the drive belt 16 wound between the output pulley 12 secured at the output shaft of the motor 11 and the winding pulley 14 rotatably mounted on the motor mounting 10. In other words, the belt engaging pulley 33 becomes in contact from the outside with a surface of the drive belt 16 which surface is opposite to the surface engaging with the output pulley 12 and the winding pulley 14.

Further, in order to ensure the engagement between the belt engaging pulley 33 and the drive belt 16, a tension spring 50 (FIG. 1) is disposed horizontally between the end of the swing lever 34 and the machine frame (not shown), so that the belt engaging pulley 33 is pressed against the outer surface of the drive belt 16 by means of the spring 50.

Because of the above-described construction, when the lock member 43 is engaged with the engaging portion 17*c* of the rod 17*a* by turning the lock lever 44, the motor mounting 10 and the spindle mounting 30 are locked in one body, and the belt engaging pulley 33 and the drive belt 16 engage with each other so that as described above, the rotation of the motor 11 is transmitted from the drive belt 16 to the friction discs 31 of the spindles 32*a*, 32*b* and 32*c* through the belt engaging pulley 33. When the rotational direction of the motor 11 is changed, the rotational direction of the friction discs 31 is changed, and thus, the twisting direction of the friction false twisting device can readily be changed.

In this embodiment, as described above, the belt engaging pulley 33 is in contact with the outer surface of the drive belt 16. Thus, when the friction discs 31 of the friction false twisting device are required to be checked, to be adjusted or to be replaced with new parts, the lock lever 44 is turned in a direction opposite to that described above so that the lock member 43 is disengaged from the engaging portion 17*c* of the rod 17*a*. Under this condition, the spindle mounting 30 is pulled in a horizontal direction. Thus, the spindle mounting 30 can be pulled out in a horizontal direction without any interruption, and the spindles 32*a*, 32*b* and 32*c* and the friction discs 31 can be removed together with the spindle mounting 30. Further, since the pulling direction is horizontal, the pulling operation can be effected smoothly and easily without any collision with parts disposed on the textile machine at positions above and below the friction false twisting device.

In FIGS. 1 to 3, reference numeral 60 designates an auxiliary equipment mounting bracket for mounting an auxiliary equipment (not shown) for threading a yarn into the friction false twisting device upon threading operation. Further, in FIG. 2, the yarn departing from the false twisting device of the present invention is guided by means of a guide 71, through a sensor pin 72 of a tension sensor and then is fed to a take-up via a guide 71. Thus, based on the tension value detected by the tension sensor, the tension in the yarn can be controlled at a predetermined value.

In this embodiment, it is preferable to disposed a sensor 73 (FIG. 3) for detecting the rotational speed near the belt engaging pulley 33, spindle drive belt 41 or one of the three spindles 32*a*, 32*b* and 32*c*, and that based on the detected rotational speed, the rotation of the drive motor 11 is controlled. Thus, it may be possible to operate a plurality of work stations disposed on a yarn texturing machine in different operational conditions.

Another embodiment of the present invention will now be explained with reference to FIGS. 4 and 5, wherein parts the same as those illustrated in FIG. 1 are designated by the same reference numerals and their detailed explanation is omitted.

The first point of the largest differences in this second embodiment compared with the above-explained first embodiment is that the number of the winding pulleys which is disposed on the motor mounting 10 is two in this embodiment. More specifically, winding pulleys 14 and 14' (see FIG. 5) are disposed, and the drive belt 16 runs between the output pulley 12 and two winding pulleys 14 and 14' in a triangular form. The second point of the largest differences is that, although in the above-described first embodiment, the swing lever 34 was supported coaxial with one spindle 32*a* of the three spindles 32*a*, 32*b* and 32*c* and had the belt engaging pulley 33 at the end thereof, in this second embodiment, one spindle 32*a* of the three spindles 32*a*, 32*b* and 32*c* has a belt engaging pulley 33 at the end thereof. As a result of direct connection of the belt engaging pulley 33 to the spindle 32*a*, the drive force is directly transmitted from the spindle 32*a* to the belt engaging pulley 33. The belt engaging pulley 33 is pressed against the drive belt 16 extending between the winding pulleys 14 and 14' (see FIG. 5). Other constructions are the same as those in the above-described embodiment.

In the above-described first and second embodiments, a flat belt 16 was used for the drive belt, and the output pulley 12 and the winding pulleys 14 and 14' around which the flat drive belt was wound had flat surfaces. However, the output pulley 12 and the winding pulleys 14 and 14' may be toothed pulleys, and the drive belt may be a toothed belt. In this case, the toothed belt may have teeth on one side. More specifically, the toothed belt has teeth only on its inner side which engages with the output pulley 12 and the winding pulleys 14 and 14'. Alternatively, the toothed belt may have teeth on both sides, i.e., not only on the inner side but also on the outer side. In the latter case, it is preferable that the belt engaging pulley 33 has teeth on the outer surface thereof, so that the engagement between the toothed belt and the toothed pulley is ensured.

Further, the above-described embodiments had such a construction that a single spindle drive belt 41 runs around the outer surfaces of the pulleys 40 secured to the three spindles 32*a*, 32*b* and 32*c* along three sides of a triangle and drives the three spindles 32*a*, 32*b* and 32*c*. However, the present invention is not limited to such a driving construction, and driving power may be transmitted from a spindle, for example, spindle 32*a*, to the other spindles 32*b* and 32*c*. Such embodiments are illustrated in FIGS. 6 and 7.

Figure 6:
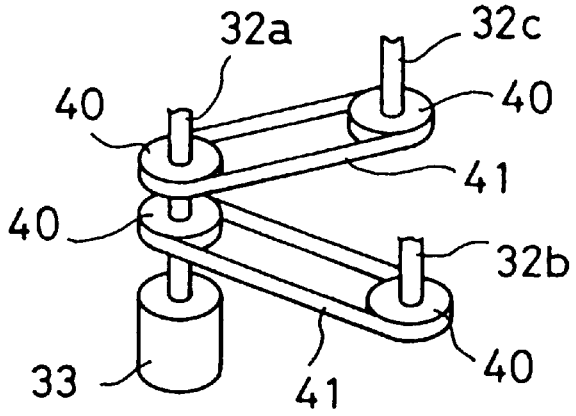
FIG. 6 is a perspective view of a still other embodiment of the present invention.

In FIG. 6, the spindle 32*a* has a belt engaging pulley 33 secured to a lower end thereof. Above the belt engaging pulley 33, vertically overlapped pulleys 40 and 40 are disposed. Contrary to this, the spindle 32*b* has a first pulley 40 corresponding to one of the vertically overlapped pulleys 40 and 40 (in FIG. 6, the lower pulley 40), and a first drive belt 41 is wound between the lower (first) pulley 40 of the spindle 32*a* and the pulley 40 of the spindle 32*b*. In addition, the spindle 32*c* has a pulley 40 at the lower end thereof at a position corresponding to the other (second) pulley 40 disposed above the above-described first pulley 40, and another (second) drive belt 41 is wound between these second pulleys 40 and 40.

Figure 4:
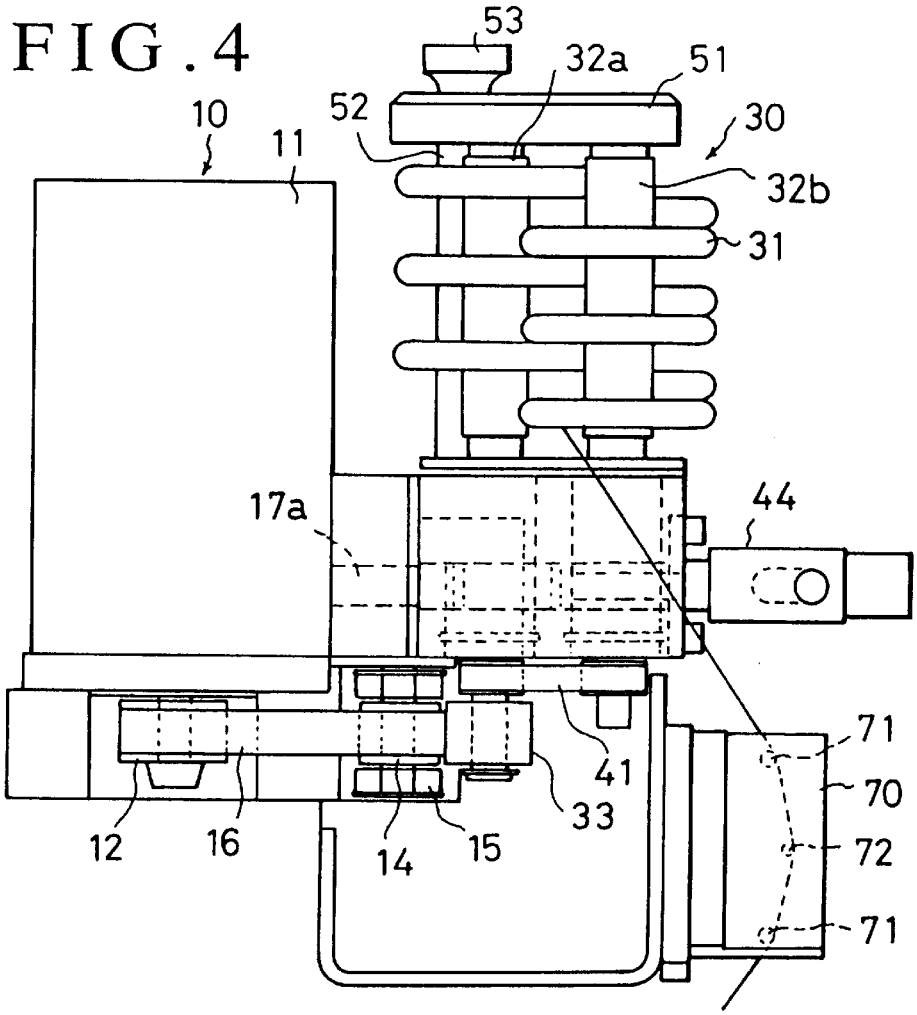
FIG. 4 is a front view of another embodiment of the present invention.
Figure 5:
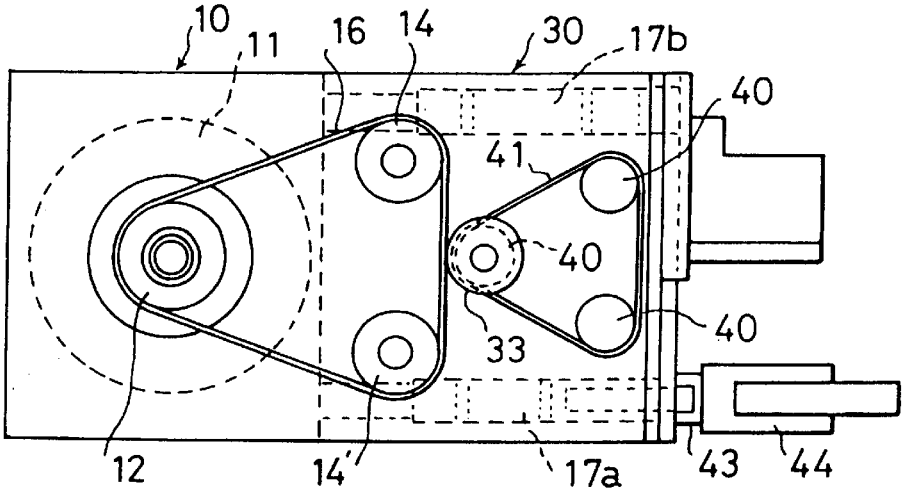
FIG. 5 is a bottom view of FIG. 4.

In the above-described embodiments, below the three spindles 32*a*, 32*b* and 32*c*, a yarn fed from the friction discs 31 of the friction false twisting device was guided along a yarn passage deviated toward the operating space as illustrated in FIGS. 2 and 4 so as to prevent the yarn from passing through a space surrounded by the drive belt 41. Contrary to this, because of the above-described construction, as illustrated in FIG. 6, the yarn can be guided straightly without causing such a deviation.

Figure 7:
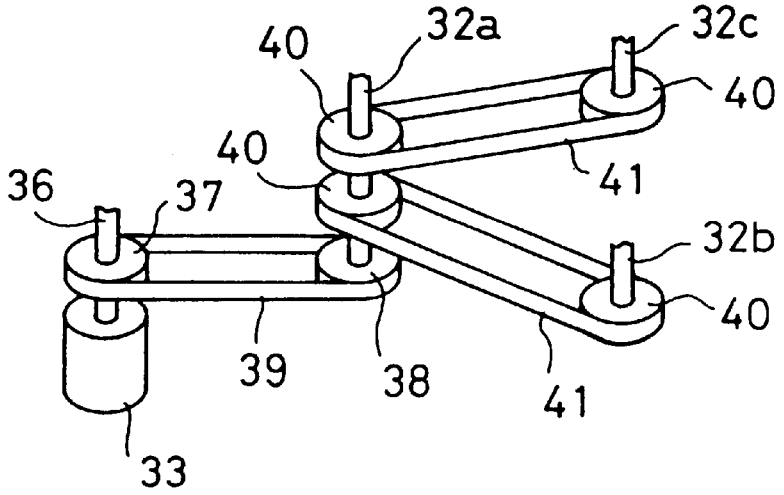
FIG. 7 is a perspective view of a still further embodiment of the present invention.

Further, in the embodiment illustrated in FIG. 7, similarly to the first embodiment, the swing lever 34 (FIG. 1) is disposed swingably about the first spindle 32*a* and has an belt engaging pulley 33 rotatably supported at an end thereof. The rotation of the belt engaging pulley 33 is picked up by means of pulleys 37, the belt 39 and the pulley 38, and it is transmitted to the spindle 32*a*. Then, the drive force is transmitted to the other spindles 32*b* and 32*c* in a manner similar to that in the embodiment illustrated in FIG. 6.

Figure 8:
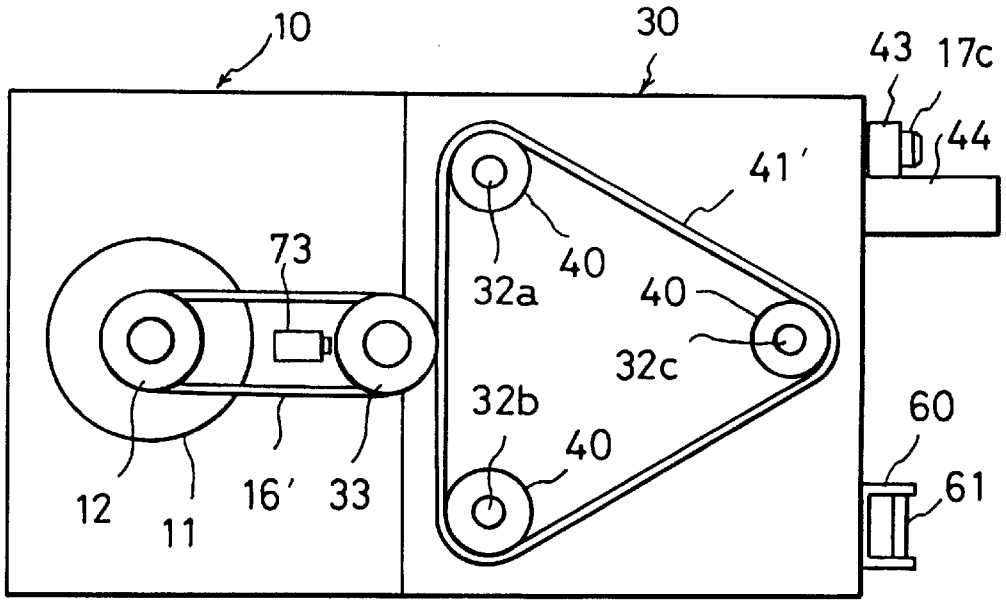
FIGS. 8 and 9 are perspective views of other different embodiments, respectively.

A still further embodiment of the present invention is illustrated in FIG. 8. In FIG. 8, a motor mounting 10 is fixedly secured to the yarn texturing machine and has a spindle drive motor 11 mounted thereon. The motor 11 has an output pulley 12 secured to the output shaft thereof, and the motor mounting 10 has a belt engaging pulley 33 rotatably mounted at a fixed position thereof. A transmittal belt 16' is wound between the output pulley 12 and the belt engaging pulley 33, and the belt engaging pulley 33 can be rotated by means of the motor 11 via the output pulley 12 and the transmittal belt 16'.

Like the above-described embodiments, a spindle mounting 30 has three spindles 32*a*, 32*b* and 32*c* rotatably mounted at apexes of an imaginary triangle. Although the positions of the spindles 32*a*, 32*b* and 32*c* are symmetrical to those of the above-described embodiments, the other constructions are substantially the same as those of the above-described embodiments, and each spindle has a plurality of friction discs (not shown) mounted thereon. The three spindles 32*a*, 32*b* and 32*c* has pulleys 40 secured to the lower ends thereof, and a drive belt 41' is wound around the three pulleys along a triangular form. The pulleys 40 are toothed pulley, and it is preferable that the drive belt 41' is a toothed belt.

Similar to the above-described embodiments, the motor mounting 10 has rods 17*a* and 17*b* (not shown) extending horizontally therefrom, and the spindle mounting 30 has through holes 42 (not shown) formed therein through which the rods 17*a* and 17*b* can be inserted. After the rods 17*a* and 17*b* of the motor mounting 10 are inserted into the through holes 42 of the spindle mounting 30, the lock lever 44 is operated in a manner similar to that applied to the above-described embodiments, and the lock member 43 is engaged with the engaging portion 17*c* formed at the end of the rod 17*a* so that the spindle mounting 30 can be fixedly secured to the motor mounting 10.

In the embodiment illustrated in FIG. 8, in a condition wherein the spindle mounting 30 is thus fixed to the motor mounting 10, the belt engaging pulley 33 engages with the drive belt 41' from the outer surface of the drive belt 41', which is extending between the pulleys 40 secured to the lower ends of the spindles 32*a*, 32*b* and 32*c*, in other words from the surface opposite to that engaging with the pulleys 40. As a result, the rotational force of the motor 11 is transmitted to the belt engaging pulley 33, and the spindles 32*a*, 32*b* and 32*c* are rotated in the same direction by the drive belt 41' and the pulleys 40.

Although the belt engaging pulley 33 was rotatably supported on the motor mounting 10 at a fixed position in the above-described present embodiment, the belt engaging pulley may be rotatably supported at an end of a swing lever (not shown) which is swingable about output shaft of the motor 11. Thus, the belt engaging pulley 33 may be pressed against the drive belt 41' by means of a spring extending from the swing lever.

Figure 9:
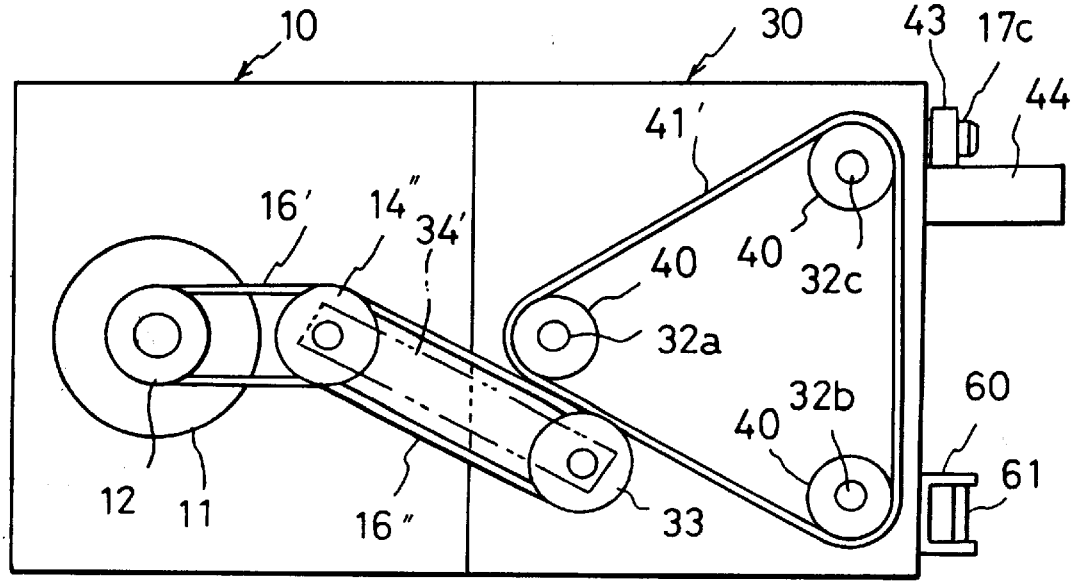

An alternative to the embodiment illustrated in FIG. 8 is shown in FIG. 9. In the embodiment illustrated in FIG. 9, the disposition of the spindles 32*a*, 32*b* and 32*c* is similar to that explained with the embodiments illustrated in FIGS. 1 to 7, in other words, symmetrical to that illustrated in FIG. 8. The motor mounting 10 has a winding pulley 14" rotatably mounted thereon at a fixed position spaced from the output shaft of the motor 11, and a transmittal belt 16' is wound between the output pulley 12 and the winding pulley 14".

The winding pulley 14" has two circumferential grooves which are vertically overlapped, and a swing lever 34' is supported swingably about the axis of the winding pulley 14". The swing lever 34' has a belt engaging pulley 33 rotatably mounted at an end thereof. A transmittal belt 16" is wound between the winding pulley 14" and the belt engaging pulley 33 so that rotational force is transmitted to the belt engaging pulley 33 from the motor 11 via the output shaft 12, the transmittal belt 16', the winding pulley 14" and the transmittal belt 16". Other constructions are similar to those in the above-described embodiments, and accordingly, their detailed explanation is omitted here.

In this embodiment illustrated in FIG. 9, in a condition wherein the spindle mounting 30 which have been attached to the motor mounting 10 is locked by means of the lock member 43, the belt engaging pulley 33 engages with the drive belt 41' which is wound around the pulleys 40 secured to the lower ends of the spindles 32*a*, 32*b* and 32*c* and rotates the spindles 32*a*, 32*b* and 32*c*.

In order to ensure the engagement between the belt engaging pulley 33 and the drive belt 41', it is preferable that a tension spring (not shown) is disposed so that the belt engaging pulley 33 is surely pressed against the drive belt 41'.

It is preferred that in the embodiments illustrated in FIGS. 8 and 9, a sensor 73 (FIG. 8) is disposed for detecting the rotational speed of the belt engaging pulley 33, the drive belt 41' or the spindle 32*a*, 32*b* or 32*c* and that the rotation of the motor 11 is controlled based on the rotational speed detected by this sensor.

Further, in the above-described embodiments, the three spindles 32*a*, 32*b* and 32*c* were driven by a single spindle drive belt 41 which runs along three sides of a triangle which encircles the outer surfaces of the pulleys 40 secured to the spindles 32*a*, 32*b* and 32*c*. The present embodiment is not limited to this driving system, and similar to the embodiments illustrated in FIGS. 7 and 8, power force may be transmitted from a single spindle, for example, spindle 32*a*, to the other spindles 32*b* and 32*c*, respectively.

Advantages of the Invention

According to the present invention, each false twisting devices with three spindles and a plurality of friction discs can be controlled by an individual drive motor. Accordingly, any long tangential belt is unnecessary, and thus noise generated by the long tangential belt can be reduced.

Further, according to the present invention, since each false twisting devices with three spindles and a plurality of friction discs can be controlled individually, even in a single yarn texturing machine, a plurality of work stations can be operated in different operating conditions.

According to the present invention, since the rotational direction of the spindles can be changed when the rotational direction of the drive motor is changed, and thus the twisting direction can be easily changed.

In addition, due to the simple construction of the present invention, the spindle mounting having spindles mounted thereon can be easily removed by pulling the spindle mounting in a lateral direction, i.e., in a horizontal direction relative to the motor mounting. Further, upon this removal operation, collision of the spindle mounting to other parts mounted on the yarn texturing machine or damages thereby does not occur, and the removal operation is very easy. Furthermore, upon removal operation, the spindle mounting can be removed from the motor mounting only by operation of the lock lever. Accordingly, the removal operation is very simple and can be done quickly.

I claim:

1. A motor drive type false twisting device with three spindles and a plurality of friction discs comprises:

a motor mounting which is fixedly secured to a yarn texturing machine and which has a motor mounted thereon for driving at least one of the spindles;

a spindle mounting which has the three spindles provided with a plurality of the friction discs rotatably mounted thereon at apexes of an imaginary triangle and which can be attached to and detached from the motor mounting;

the motor mounted on the motor mounting having an output pulley attached to an output shaft thereof, the motor mounting having a winding pulley rotatably mounted thereon, the output pulley and the winding pulley having a drive belt wound therearound, the spindle mounting having a belt engaging pulley rotatably mounted thereon, and the belt engaging pulley and the three spindles being operatively connected to each other so that the rotation of the belt engaging pulley is transmitted to the spindles; and a lock member for maintaining the belt engaging pulley to engage with the drive belt at a surface opposite to that engaging with the winding pulley when the spindle mounting is attached to the motor mounting.

2. A motor drive type false twisting device with three spindles and a plurality of friction discs according to claim 1, wherein the three spindles have spindle pulleys secured thereto, respectively, and a spindle drive belt is wound around the spindle pulleys of the three spindles.

3. A motor drive type false twisting device with three spindles and a plurality of friction discs according to claim 2, wherein one of the three spindles has the belt engaging pulley secured thereto.

4. A motor drive type false twisting device with three spindles and a plurality of friction discs according to claim 2, wherein the belt engaging pulley is mounted spaced from the three spindles, and the belt engaging pulley and one of the three spindles are connected to each other by means of a belt.

5. A motor drive type false twisting device with three spindles and a plurality of friction discs according to claim 2, which further comprises a sensor for detecting rotational speed of the belt engaging pulley, the spindle drive belt or the spindles, and the rotation of the motor is controlled based on the rotational speed detected by the sensor.

6. A motor drive type false twisting device with three spindles and a plurality of friction discs according to claim 1, wherein one of the three spindles has vertically overlapped first and second spindle pulleys secured thereto, one of the remaining pulleys has a first spindle pulley secured thereto and the other remaining pulley has a second spindle pulley, a first spindle drive belt is wound between the first spindle pulleys, and a second spindle drive belt is wound between the second spindle pulleys.

7. A motor drive type false twisting device with three spindles and a plurality of friction discs according to claim 6, wherein one of the three spindles has the belt engaging pulley secured thereto.

8. A motor drive type false twisting device with three spindles and a plurality of friction discs according to claim 6, wherein the belt engaging pulley is mounted spaced from the three spindles, and the belt engaging pulley and one of the three spindles are connected to each other by means of a belt.

9. A motor drive type false twisting device with three spindles and a plurality of friction discs according to claim 1, wherein the drive belt is a flat belt.

10. A motor drive type false twisting device with three spindles and a plurality of friction discs according to claim 1, wherein the output pulley and the winding pulley are toothed pulleys, and the drive belt is a toothed belt having teeth on one side.

11. A motor drive type false twisting device with three spindles and a plurality of friction discs according to claim 1, wherein the output pulley, the winding pulley and the belt engaging pulley are toothed pulleys, and the drive belt is a toothed belt having teeth on both sides.

12. A motor drive type false twisting device with three spindles and a plurality of friction discs comprises:

a motor mounting which is fixedly secured to a yarn texturing machine and which has a motor mounted thereon for driving at least one of the spindles;

a spindle mounting which has the three spindles provided with a plurality of the friction discs rotatably mounted thereon at apexes of an imaginary triangle and which can be attached to and detached from the motor mounting;

an output shaft of the motor mounted on the motor mounting being operatively connected to a belt engaging pulley, the three spindles on the spindle mounting having pulleys secured thereto, the pulleys being operatively connected to each other by means of a drive belt; and a lock member for maintaining the belt engaging pulley to engage with the drive belt at a surface opposite to that engaging with the pulleys secured to the spindles when the spindle mounting is attached to the motor mounting.

13. A motor drive type false twisting device with three spindles and a plurality of friction discs according to claim 12, wherein the three spindles have spindle pulleys secured thereto, respectively, and a spindle drive belt is wound around the spindle pulleys of the three spindles.

14. A motor drive type false twisting device with three spindles and a plurality of friction discs according to claim 13, wherein the output shaft of the motor has the belt engaging pulley secured thereto.

15. A motor drive type false twisting device with three spindles and a plurality of friction discs according to claim 13, wherein the belt engaging pulley is mounted spaced from the output shaft of the motor, and the belt engaging pulley and the output shaft are connected to each other by means of a belt.

16. A motor drive type false twisting device with three spindles and a plurality of friction discs according to claim 13, which further comprises a sensor for detecting rotational speed of the belt engaging pulley, the spindle drive belt or the spindles, and the rotation of the motor is controlled based on the rotational speed detected by the sensor.

17. A motor drive type false twisting device with three spindles and a plurality of friction discs according to claim 12, wherein one of the three spindles has vertically overlapped first and second spindle pulleys secured thereto, one of the remaining pulleys has a first spindle pulley secured thereto and the other remaining pulley has a second spindle pulley, a first spindle drive belt is wound between the first spindle pulleys, a second spindle drive belt is wound between the second spindle pulleys, and the belt engaging pulley engages with the first or second drive belt.

18. A motor drive type false twisting device with three spindles and a plurality of friction discs according to claim 17, wherein the output shaft of the motor has the belt engaging pulley secured thereto.

19. A motor drive type false twisting device with three spindles and a plurality of friction discs according to claim 17, wherein the belt engaging pulley is mounted spaced from the output shaft of the motor, and the belt engaging pulley and the output shaft are connected to each other by means of a belt.

20. A motor drive type false twisting device with three spindles and a plurality of friction discs according to claim 12, wherein the drive belt is a toothed belt having teeth on one side.

21. A motor drive type false twisting device with three spindles and a plurality of friction discs according to claim 12, wherein the belt engaging pulley is a toothed pulley, and the drive belt is a toothed belt having teeth on both sides.

* * * * *